United States Patent [19]

Stoltzfus

[11] 4,165,545

[45] Aug. 28, 1979

[54] COMMODE CONDENSATION/OVERFLOW CATCH BASIN

[76] Inventor: Sarah D. Stoltzfus, 8645 Converse Huff Rd., Plain City, Ohio 43064

[21] Appl. No.: 863,357

[22] Filed: Dec. 22, 1977

[51] Int. Cl.[2] ..... E03D 11/00

[52] U.S. Cl. ..... 4/252 A

[58] Field of Search ..... 4/252 R, 252 A, DIG. 18

[56] References Cited

U.S. PATENT DOCUMENTS

| | | | |
|---|---|---|---|
| 918,396 | 4/1909 | Tracy | 4/252 A |
| 1,333,368 | 3/1920 | Auer | 4/252 A |
| 1,354,199 | 9/1920 | Ketteringham | 4/252 A |
| 1,641,029 | 8/1927 | Gaudet | 4/252 A |
| 2,449,445 | 9/1948 | Bodan | 4/252 A |
| 2,509,881 | 5/1950 | Qualheim et al. | 4/252 A |

*Primary Examiner*—Richard R. Stearns
*Attorney, Agent, or Firm*—Anthony D. Cennamo

[57] ABSTRACT

A moisture catch basin for a toilet (combination tank and bowl) comprising a sheet of moisture-impervious material of an overall size and configuration greater than that of the outside dimensions of said tank and bowl. The front portion of the catch basin has a slant away from the bowl and rearwardly to the rear portion thereof to form a moisture evaporation bin. A gutter is formed adjacent the outer edge of said catch basin and drainage means connect the gutter to an auxiliary drain. The catch basin is of alternate structure that may comprise a dike in the basin's outer and frontal area to provide a runoff track to the moisture evaporation area. The basin is in liquid-seal contact with the lowermost portion of said toilet.

4 Claims, 4 Drawing Figures

COMMODE CONDENSATION/OVERFLOW CATCH BASIN

BACKGROUND

The prior art is replete with various devices and schemes to overcome the moisture problem attendant with porcelain toilets. Most of the prior art devices attempt to defeat the collection of condensation on the outside of the tank by insulating the outer walls from the water. These devices recognize it is the temperature differential between the room temperature and the water temperature that causes the condensation.

Two prior art patents, U.S. Pat. Nos. 1,440,892 and 2,455,128, were noted wherein there is shown structure to cause the condensation collecting on the tank to drain into the bowl. The attendant disadvantages of the collection of the moisture in the seat area and the dripping effect are quite obvious.

Very significantly, each of the noted prior art patents were directed to the problem of condensation on the tank. Specifically, they limited themselves to the tank and completely ignored the bowl itself.

Initially, it may be stated that the bowl condensation problem—perhaps not as great as the tank—is real and present.

Again, the prior art devices are in terms of the state of the art very old, i.e., 50 years or more. At that period of time the toilet structure was that of a separate tank and bowl. With some designs the bowl and tank were not touching, other than a common water pipe.

With todays so-called streamline and more efficient designs, the tank and bowl are integrally constructed. They are effectively, if not actually, a single unit. Again, certain toilets, such as commercial toilets, do not have a tank for each bowl.

Accordingly, the condensation problem for a toilet continues to exist—but the tank solutions of the prior art are either an insufficient answer or inadequate for today's structure.

Also, as well understood, moisture does collect on the floor adjacent the toilet bowl that does not originate as condensation. This is particularly true when, on occasion, there may be cause for the toilet to overflow. Accordingly, the tank means of preventing or collecting moisture does not meet the liquid spillage problem created by the use of a toilet.

SUMMARY OF INVENTION

The present invention in a preferred embodiment comprises a catch basin to be placed beneath the toilet, or contiguous with the toilet. The catch basin is of a sufficient size to catch all condensation irrespective of where it originates on or about the toilet. The catch basin is made of moisture-impervious material, it is beveled outwardly adjacent the bowl and rearwardly. The basin has a gutter formed in its outer edge to collect the moisture around the toilet and to direct the collected moisture rearwardly to an auxiliary drain.

Alternatively, if the moisture collected is solely that of condensation, it may be desired to permit the same to evaporate into the room atmosphere. In this instance, no drain would be provided and the structure will include a rim or dike to retain the moisture in a moisture-evaporation area.

OBJECTS

It is accordingly a principal object of the present invention to provide a means for collecting all liquids, moisture, including that normally found on the floor adjacent a toilet—and on occasion overflow.

It is another object of the present invention to provide such a catch basin and direct the collected moisture to a drain or alternatively to an evaporation bin.

Other objects and features of the present invention will become apparent from the following detailed description when taken in conjunction with the drawings in which:

DETAILED DESCRIPTION OF DRAWINGS

Figure 2:
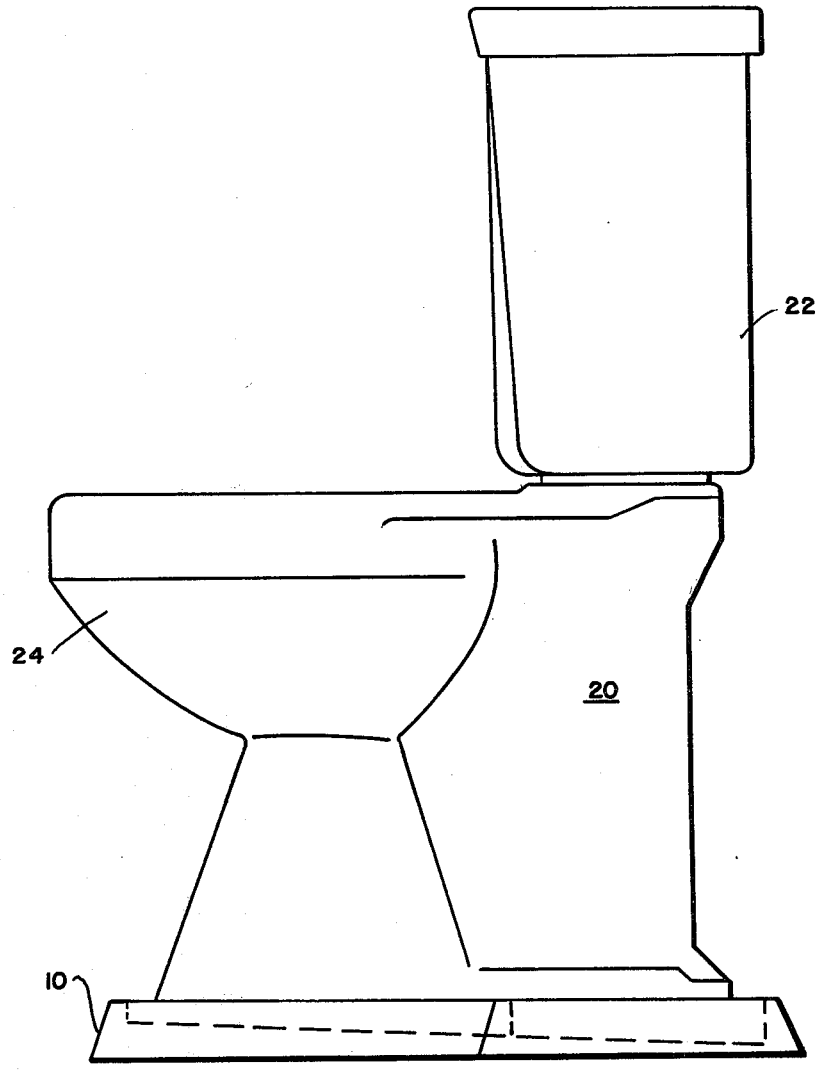
FIG. 2 is a side view of the catch basin of FIG. 1, together with a toilet of the present invention.

Referring now to the drawings and particularly to the several views, the toilet 20 comprises a flush-down water reservoir tank 22 and the bowl 24.

Figure 1:
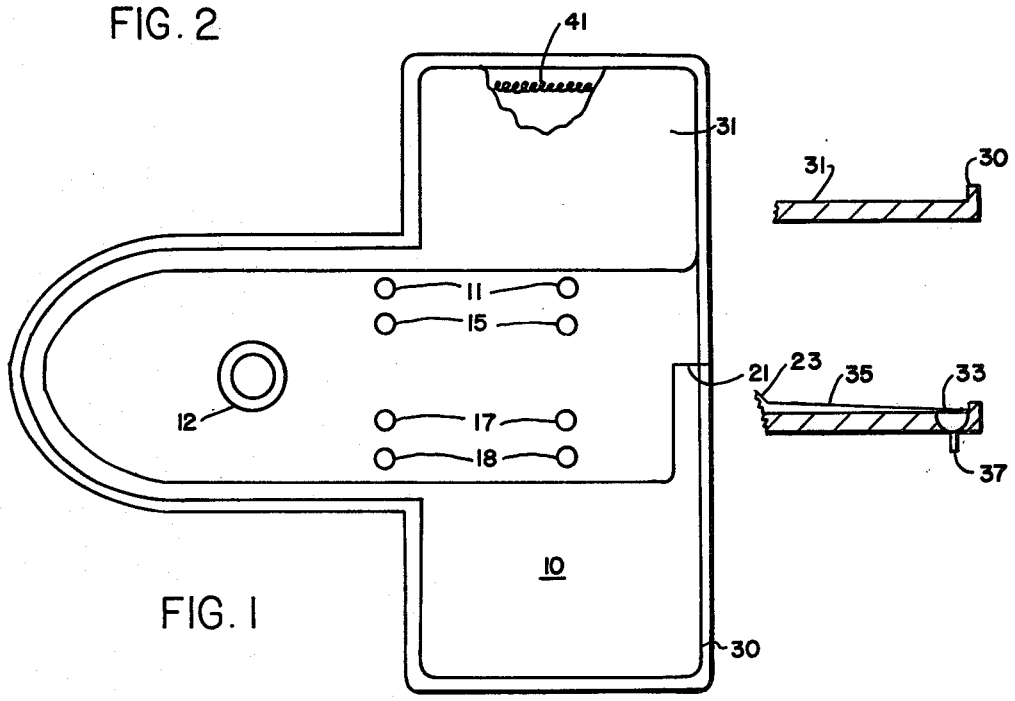
FIG. 1 is a top view of the catch basin for a toilet of the present invention.

With reference to FIG. 1, there is shown the toilet floor mounting studs 11 and 13, together with the floor mounting studs 15 and 17 of a conventional toilet arrangement. The drain 12 is the standard drain that is sealed to the toilet—when in position by a ring seal.

With continued reference to FIG. 1 and with reference to FIG. 2, there is illustrated the catch basin 10 of the present invention having the toilet 20 positioned thereon in its most standard form, however, other configurations are equally adaptable. Condensation collecting and dripping down will fall directly beneath the outside walls. Accordingly, the catch basin 10 has a size in its crossdirection greater than the crossdirection of the tank 22. In this way the moisture drips down and onto the catch basin.

Figure 4:
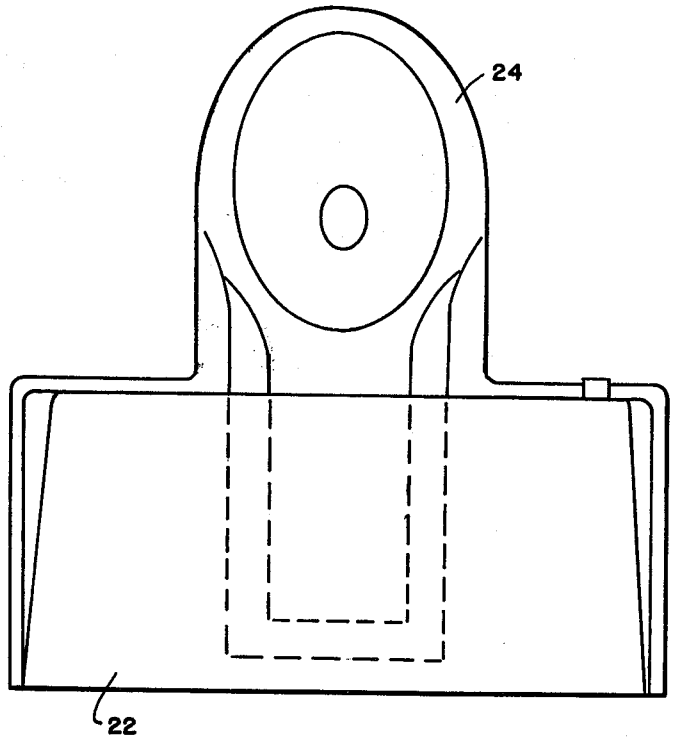
FIG. 4 is a top view of the catch basin for a toilet of the present invention.
Figure 3:
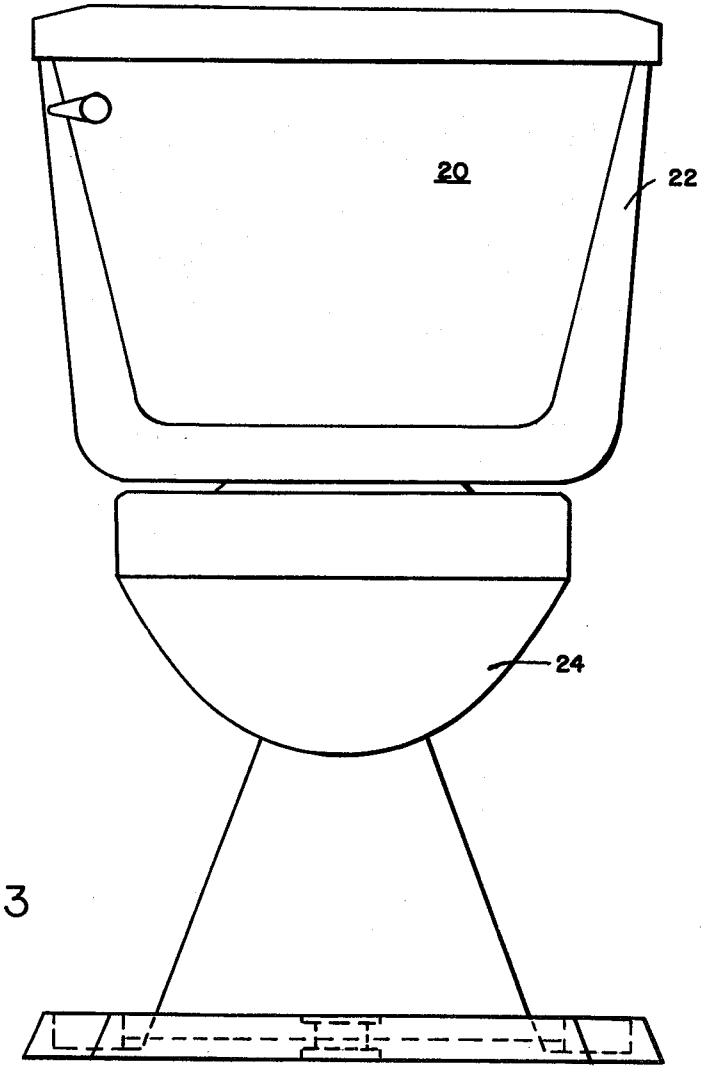
FIG. 3 is a front view of the catch basin for a toilet of the present invention.

The outside wall of the bowl (commode) is not straight up and down but is curved re-entrantly and then flared. Accordingly, in this particular illustration the front portion of the catch basin 10 need not be as large in its crossdirection as that of the bowl 24. The relative dimensions are shown more explicitly in FIGS. 3 and 4.

In a first preferred embodiment, the catch basin 10 is a continuous structure with apertures for the mounting studs and drain as shown in FIG. 1. In this embodiment the toilet is removed, the catch basin positioned over the mounting studs, and the toilet replaced.

In a second embodiment, in those instances where it is not desired to unmount the toilet, the catch basin 10 has its middle portion removed. That portion removed is somewhat smaller in size than the size of the underpart of the bowl 24. That is, that portion of basin 10 that otherwise would be under the toilet is removed. To assure there is a moisture seal or contact of the basin 10 with the toilet 24, a lip 23 on the inside of the basin 10 adheres to the wall of the toilet 24. The lip 23 is sufficiently large and flexible to adhere to toilets having varying outside diameters. The split 21 is for purposes of wrapping the catch basin around the toilet upon installation. Other means of providing a liquid seal contact between the bowl and the basin can be envisioned.

In the embodiment of the catch basin 10 shown in cross section of FIG. 1, there is a rim or dike 30 to constrict the moisture collecting on the basin.

The basin is beveled, i.e. slants away from the bowl towards its outer edge adjacent the dike and thence, rearwardly to the rear-most portion of the basin. In this way, that portion 31 of the basin, free from the bowl, is operative effectively as the collection area of all moisture. In that this portion 31 is open and the largest in area, it forms an evaporation bin.

In those instances, where it is more desirable to drain the liquid, the mat 35 is slanted towards the gutter 33 from where the liquid is drained via line 37, to an auxiliary drain. It has been found to connect to the commode drain may cause the emission of undesireable odors.

In the event the collection of liquid in the evaporation bin 31 is excessive and simple evaporation is not sufficient, there may be included therewith a heating element 41 or other air evaporation assist means.

Although only certain and specific embodiments are shown and described, it is to be understood modifications may be had without departing from the true spirit and scope of the invention.

What is claimed is:

1. A liquid catch basin for a toilet having a cross tank and a bowl, said basin of a single unitary structure having a generally T-shape with the crossportion thereof completely underlying the bottom of the cross tank, a central portion of said catch basin being in contact with the lowermost portion of said bowl and extending below said bowl and means for retaining said basin in contact with said bowl;

said catch basin has its central area removed from said central portion extending below said bowl, and the inner edge of said basin adjacent of said removed central area is in sealing contact to said bowl;

a gutter adjacent the outer edge of said basin, and a dike formed on the outer edge of said gutter, and wherein said basin is slanted outwardly from said bowl to said outer edge dike and thence rearwardly to form an evaporation bin.

2. The catch basin of claim 1 wherein said evaporation bin further comprises a drainage means.

3. The catch basin of claim 2 wherein said drainage means is a tubular interconnection with an auxiliary drain.

4. The catch basin of claim 1 wherein said evaporation bin further comprises means for assisting the evaporation of the liquid collected thereon.

* * * * *